US006618860B1

(12) United States Patent
Sullivan et al.

(10) Patent No.: US 6,618,860 B1
(45) Date of Patent: Sep. 16, 2003

(54) ATHLETIC GLOVES FOR USE WHEN CYCLING AND METHOD OF MAKING

(75) Inventors: Sean Sullivan, Boulder, CO (US); Jonathan Robert Knoll, Boulder, CO (US)

(73) Assignee: DashAmerica, Inc., Broomfield, CO (US)

( * ) Notice: Subject to any disclaimer, the term of this patent is extended or adjusted under 35 U.S.C. 154(b) by 0 days.

(21) Appl. No.: 10/192,953

(22) Filed: Jul. 11, 2002

(51) Int. Cl.[7] ..... A41D 19/00
(52) U.S. Cl. ..... 2/159; 2/161.1
(58) Field of Search ..... 2/159, 160, 161.1, 2/161.2, 161.6, 169, 16, 20, 412, 413, 414; 294/25; 473/205

(56) References Cited

U.S. PATENT DOCUMENTS

| | | | | | |
|---|---|---|---|---|---|
| 2,465,136 | A | | 3/1949 | Troccoli | 2/159 |
| 3,597,765 | A | | 8/1971 | Stanton | 2/159 |
| 4,038,787 | A | | 8/1977 | Bianchi | 51/391 |
| 4,329,741 | A | | 5/1982 | Bach | 2/161 A |
| 4,691,387 | A | | 9/1987 | Lopez | 2/161 A |
| 5,271,101 | A | * | 12/1993 | Speth et al. | 2/228 |
| 5,274,846 | A | * | 1/1994 | Kolsky | 2/460 |
| 5,345,609 | A | * | 9/1994 | Fabry et al. | 2/20 |
| 5,365,610 | A | * | 11/1994 | Lubahn et al. | 2/23 |
| 5,423,087 | A | * | 6/1995 | Krent et al. | 2/463 |
| 5,581,809 | A | | 12/1996 | Mah | 2/20 |
| 5,598,582 | A | | 2/1997 | Andrews et al. | 2/16 |
| 5,790,980 | A | | 8/1998 | Yewer, Jr. | 2/20 |
| 5,819,312 | A | | 10/1998 | Snyder et al. | 2/16 |
| 5,896,580 | A | * | 4/1999 | Aldrich et al. | 2/24 |
| 5,926,847 | A | | 7/1999 | Eibert | 2/161.2 |
| 5,987,642 | A | | 11/1999 | Webster | 2/19 |
| 6,154,885 | A | | 12/2000 | Kobayashi et al. | 2/161.3 |
| 6,216,276 | B1 | | 4/2001 | Eibert | 2/161.2 |
| 6,393,618 | B2 | * | 5/2002 | Garneau | 2/228 |
| 6,408,446 | B1 | * | 6/2002 | Carrington | 2/465 |

* cited by examiner

*Primary Examiner*—Gary L. Welch
(74) *Attorney, Agent, or Firm*—Holland & Hart LLP; Francis A. Sirr, Esq.

(57) ABSTRACT

Athletic gloves used by a person when operating a bicycle include a plurality of three-layer palm pads that are glued to a plurality of spaced positions on the palm of each glove without the use of stitching and the like. Each of the palm pads is formed of a three-layer assembly, i.e. a relatively thin heat-activated adhesive layer, a relatively thick and intermediate synthetic foam layer, and a relatively thin synthetic leather layer. Prior to assembly of a three-layer palm pad onto the palm of a glove, each of the three layers of the palm pad assembly is of a uniform thickness. A heat press having a pattern of downward-extending metal line areas, including one metal line area that matches and completely encircles the circumferential edge of each palm pad, operates to press each palm pad down onto the palm of the glove. This heat and line pressure operates to activate the palm pad adhesive layer, to thereby provide a thin line seal at the edge of each palm pad, and to also provide a pattern of thin depressed lines within each palm pad. This pattern of thin depressed lines operate to form a plurality of raised or embossed pad areas within each palm pad. The palm pads and their pad areas are strategically located on the palm of a user's hand to facilitate the bending of the glove, as the user's hand grasps an object such as the handlebar of a bicycle.

23 Claims, 2 Drawing Sheets

ATHLETIC GLOVES FOR USE WHEN CYCLING AND METHOD OF MAKING

CROSS-REFERENCE TO RELATED APPLICATIONS

U.S. patent application Ser. No. 10/012,922, filed Oct. 22, 2001, and entitled CHAMOIS FOR CYCLING PANTS AND METHOD OF MAKING by Robbin D. Forsyth and Jonathan R. Knoll, incorporated herein by reference.

BACKGROUND OF THE INVENTION

1. Field of the Invention

This invention relates to the field of apparel to be worn by humans, and more specifically, to athletic gloves having palm-located pads or cushions that are constructed and arranged to aid a cyclist in gripping the handlebar of a bicycle as the palm pads protect, cushion and pad the hands of the cyclist.

2. Description of the Related Art

Athletic gloves, and particularly cycling gloves, of various configurations have become popular because they aid in gripping the handlebar of a bicycle, they are durable, they provide cushioning, they protection to the hands of the cyclist in the case of a fall, and they minimize abrasion to the hands of the cyclist.

The following examples of athletic gloves are incorporated herein by, reference.

U.S. Pat. No. 6,216,276 (which is a continuation-in-part of U.S. Pat. No. 5,926,847) describes a padded athletic glove wherein pre-formed, air-blown, silicon foam pads are stitched onto the glove, or are applied to the glove using an adhesive. Cycling gloves are mentioned wherein protective padding is provided on the palm and/or fingers of the glove, Athletic gloves are described that protect the palms and/or fingers, athletic gloves are described that assist in the catching of a ball or another object, and athletic gloves are described that enhance the gripping of an object already that is held in the hand. Pads are described that range from about 0.010-inch to about 0.012-inch thick, having a durometer range of about 45 Shore A to about 55 Shore A, and having a specific gravity of about 1.12 to about 1.16.

U.S. Pat. No. 5,987,642 describes a batting glove that includes shock-absorbing vinyl nitril pads (about 1/16 to 3/32-inch thick) that are glued to the glove and then covered by a thin layer of leather that is sewn to the glove.

U.S. Pat. No. 5,598,582 describes a heat-resistant glove having a raised silicone portion that is formed on the palm by applying the silicone through a nozzle to form a computer-controlled pad pattern, whereupon the silicone is cured.

U.S. Pat. No. 5,790,980 describes a stitched and padded glove that includes a heat softening, slow recovery, medium density, polyurethane foam pad that, when heated by the hand, conforms to the shape of the hand.

U.S. Pat. No. 4,038,787 describes an abrasive glove wherein the palm/fingers of the glove include abrading pads whose upper layer contains grit particles, and whose lower layer is a waterproof adhesive.

U.S. Pat. No. 5,581,809 describes a protective glove having a number of spaced pads that edge to edge abut when the glove is closed on to an object, so as to form a generally continuous pad for the hand. The use of pads that are made from natural or synthetic rubber, natural or synthetic rubber foams with open or closed cells, polymeric (polyurethane and polystyrene) foams with open or closed cells, or impact absorbent gels that may require a containment pouch, are suggested.

SUMMARY OF THE INVENTION

Embodiments of the invention provide athletic gloves having a number of strategically-located palm pads, each palm pad being formed from three flexible layers, sheets or pieces, i.e. a relatively thin and lower heat-sensitive adhesive layer, film or membrane that may be formed of a thermoplastic polymer such as polyurethane (PU) or of a synthetic thermoplastic polymer such as polyvinyl chloride (PVC), a relatively thick and middle layer that may be formed of a heat-meltable or heat-deformable synthetic foam, and a relatively thin and upper layer that may be formed of a synthetic leather.

In accordance with the invention, each palm pad includes one continuous heat/pressure-formed depression line that closely follows the edge or boarder of each palm pad. In this manner, the thickness of each palm pad is materially reduced along its edge, such that the thickness of the edge is generally equal to only the thickness of the palm pad upper synthetic leather layer. Thus, the edge of each palm pad blends smoothly into the fabric material that forms the palm of the athletic glove.

In embodiments of the invention, each of the relatively thick palm pads includes a number of thin, heat/pressure formed, depression lines or fold creases that lie internal of the palm pads, and that travel across the area of the palm pad, so as to divide each palm pad into a number of relatively thick pad areas that are joined or outlined by the thin depression lines; i.e., each relatively thick palm pad is embossed by operation of the thin depression lines that traverse the area of the palm pad.

In a first embodiment of the invention the above described relatively thick and smaller pad areas that lie internal of the above describe and relatively larger palm pads are formed by depression lines that include a compress portion of the middle foam layer. In a second embodiment of the invention each of the above described thick and relatively smaller pad areas includes its own individual thick and middle foam area, i.e. the depression lines that lie within the relatively larger palm pad do not include a compress foam layer.

The construction and arrangement of athletic gloves to which palm pads in accordance with the invention are adhesively attached, bound, or "welded" in the presence of heat and pressure, and in the absence of stitching or the like are not critical to the invention.

While the invention finds general utility in athletic gloves, including gloves in which padding and/or protection is provided for only the back of the glove, or gloves in which padding and/or protection is provided for both the back and the palm of the glove, non-limiting embodiments of the invention will be described where athletic gloves in the form of cycling gloves include a palm side that is formed of a perforated or breathable synthetic leather, a back side that is formed of an elastic textile material, for example a polyurethane elastic textile such as Spandex or Lycra, and a wrist-encircling portion that includes a hook and loop closure member such as Velcro.

Cycling gloves having palm pads in accordance with the invention aid a cyclist in gripping the handlebar of a bicycle, as the glove palm pads support, protect, dampen and absorb shock, and pad the cyclist's hands, and as the glove palm pads minimize the occurrence of numbness of the hands of a cyclist.

When athletic gloves constructed and arranged in accordance with the invention are worn, the upper or synthetic leather layer of each of the palm pads is exposed, and this upper layer aids in the gripping of an object such a the handlebar of a bicycle.

As used herein, the term foam or foam layer means a flexible, porous, natural or synthetic material whose volume contains a relatively high percentage of open or closed cells, and a relatively low percentage of the natural or synthetic material from which the foam is formed. While the spirit and scope of the invention is not to be limited thereto, in an embodiment of the invention, the foam layer within each palm pad had a thickness of about 5 millimeters (mm), and hardness of from about 40 durometer (40 d) to about 90 d, as measured by a durometer A normal density, polyester based, expanded polyurethane foam is known to have a density of about 20 d, whereas a relatively high density, polyester based, expanded polyurethane foam has a hardness in the range of from about 40 d to about 90 d, and foams of this type can be used in accordance with the invention.

The term foam or foam layer, as used herein, is also intended to include a foamed or expanded plastic material that has been treated so as to cause air or gas bubbles or cells to be formed therein, these cells being, either closed cells or open cells. However, within the spirit and scope of the invention, the term foam or foam layer includes both presently known and after-developed equivalent means, such as gel-filled members and/or liquid-filled members. A non-limiting example is an open cell polyurethane foam.

While the invention will be described while making reference to the use of foam that may include open cell and/or closed cell foams, the spirit and scope of the invention includes the use of both existing equivalent foam members and after developed equivalent foam members. Examples of existing and equivalent foam members include, but are not limited to, gel-filled foam members, liquid-filled foam members, air-filled foam members, and combinations thereof In an embodiment of the invention, the thickness of the palm pad adhesive layer and the thickness of the palm pad synthetic leather layer were each considerably less than the 5 mm thickness of the foam layer, and the thickness of the adhesive and synthetic leather layers are not critical to the invention. Without limitation thereto, the adhesive layer is a thin film having a thickness of about 0.2 mm, and the top synthetic leather layer may have a thickness of about 1.0 mm.

In an embodiment of the invention, but without limitation thereto, the selective application of heat and pressure to the above-described palm pads in order to form the above-described edge-located depression line and the internal depression line(s) occurred at from about 90 to about 100 degrees C. at a pressure of about 4 kilograms per square centimeter, and this heat and pressure was applied for about three seconds.

In accordance with the invention, the selective application of heat and line pressure to the above-described palm pads operates to adhesively attach the palm pads to the palm of an athletic glove.

In a first embodiment of the invention the relatively thick foam layer within each palm pad is permanently melted and cut by the application of heat and pressure to a thin layer, to thereby form thin depression lines within each of the palm pads.

In a second embodiment of the invention each palm pad that includes internal pad areas is provided with a number of relatively thick foam layers that individually define the individual internal pad areas, and the application of heat and pressure operates to secure the palm pad's upper layer without melting the relatively thick foam layers that define the individual pad areas.

The internal depression lines that are formed in one or more of the palm pads operate to divide the palm pad(s) into a number of smaller size and internal pad areas. The thickness of each pad area is equal in thickness to the sum of the upper synthetic leather layer, the uncompressed thickness of the middle foam layer, and the thickness of the adhesive layer. More generally, each of the embossed pad areas has a thickness that is only slightly greater than the uncompressed thickness of the foam layer.

In accordance with the invention, each palm pad includes one continuous depression line that encircles the edge of each palm pad, so as to provide that the edge of each palm pad is continuous sealed to the palm of the glove by the application of heat and pressure. However, within the internal area of each palm pad, a desired pattern of inner depression lines may be provided to suit the flexure needs of a particular area of the glove palm, including depression lines within a palm pad that are linear or curved, and depression lines within a palm pad that cross each other as they traverse the palm pad.

As a feature of the invention, prior to the above-described application of heat and line pressure, each of the above-described palm pads may be formed into a unitary three-layer assembly, with this unitary assembly then being adhesively attached to the palm of an athletic glove by the selective application of heat and line pressure.

As a feature of the invention, palm pads in accordance with the invention include a bottom heat-sensitive adhesive layer and a top layer a synthetic leather that have generally the same planar shape and size, and a middle foam layer that is of generally the same planar shape, but is of a somewhat smaller size. The top and bottom layer are arranged in general positional coincidence, and the middle layer is centered between the top and bottom layer, so that the circumferential edge of the palm pad comprises only the top and bottom layer. In a first embodiment of the invention the above-described middle foam layer comprises a single piece of material. In a second embodiment of the invention the above-described middle foam layer includes a number of individual foam pieces, one piece for each individual pad area that is to be formed internal of the palm pad.

Within the spirit and scope of the invention, the above-described palm pads may be adhesively attached to the palm of an athletic glove only at the location of the above-described heat and pressure, or alternatively the entire area of the palm-pad adhesive layer may be activated by heat, while only the depression line portion of a palm pad is subjected to both heat and pressure.

In addition, and as a feature of the invention, the palm pads may be "tacked" to the palm of an athletic glove, using heat in the absence of pressure, and the above-described heat and line pressure may thereafter be applied to the palm pads and the athletic glove having the palm pads "tacked" thereon.

While the term synthetic leather is used herein, it is intended that the use of a more expensive natural leather, rather than a synthetic material that is fabricated so as to imitate natural leather, is also encompassed by the term synthetic leather

DESCRIPTION OF PREFERRED EMBODIMENTS

The present invention provides athletic gloves for both male use and female use, for example cycling gloves that improve the comfort and the protection to the hands of a male/female operating a bicycle.

Figure 1:
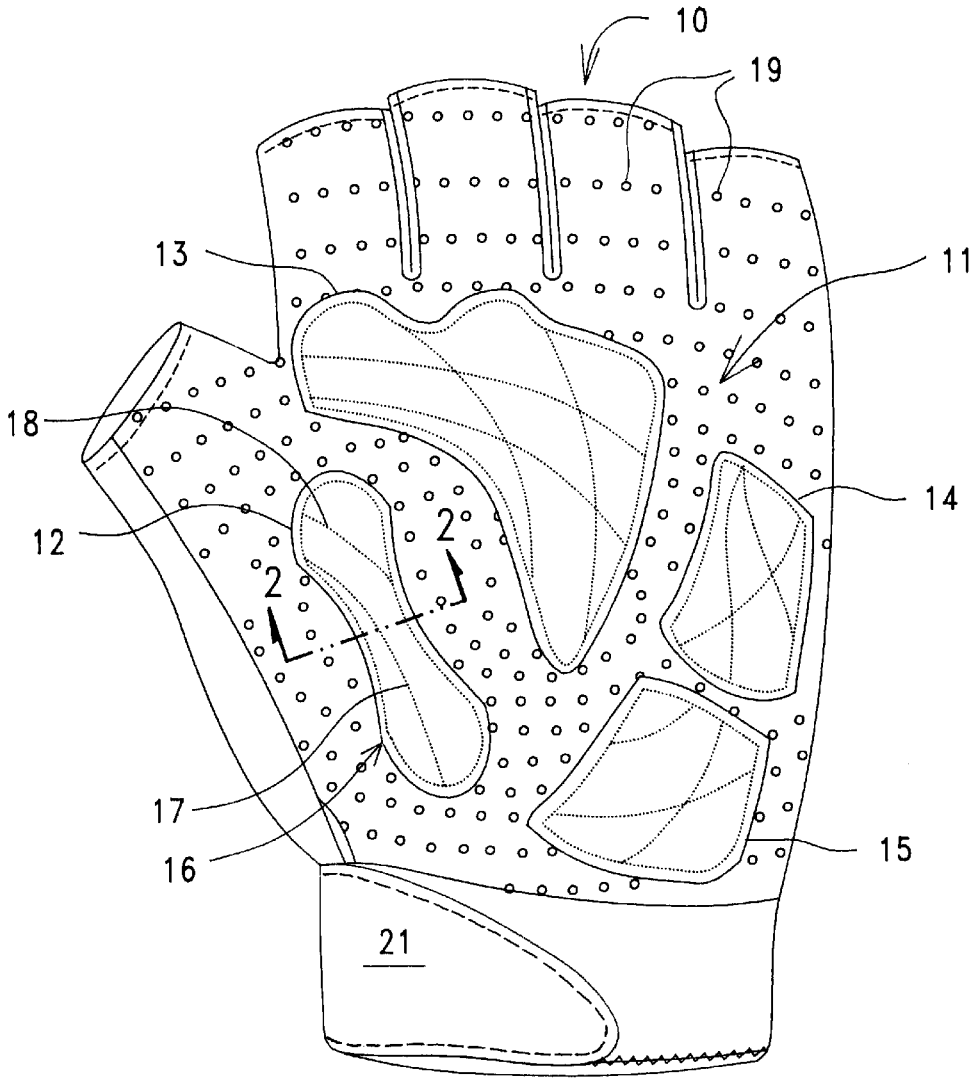
FIG. 1 is a palm-side view of a left-hand cycling glove in accordance with the invention, the cycling glove having four palm pads that are constructed and arranged in accordance with the invention, the palm pads being heat and line pressure attached to the palm of the cycling glove in accordance with the invention.

FIG. 1 is a palm side view of a left-hand cycling glove 10 in accordance with the invention, the wrist area of glove 10 including a releasable VELCRO strap 21.

More specifically, FIG. 1 shows the side of glove 10 that is adapted to engage the handlebar of a bicycle. While cycling glove 10 is shown as having short fingers, the invention also finds utility in long finger gloves, including gloves that are constructed and arranged for use in winter temperatures. In an embodiment of the invention the palm 11 of glove 10 was formed of relatively thin and flexible synthetic leather that included a pattern of small diameter through holes 19 that provide ventilation to the hand of a user.

In accordance with one embodiment of the invention, the palm 11 of glove 10 includes four individual and strategically-located palm pads 12, 13, 14, and 15 that are each constructed and arranged in accordance with this invention, and that are each adhesively attached to the palm 11 of glove 10 in accordance with this invention, and in the absence of stitching and the like.

As will be apparent, each of the four palm pads 12–15 includes (1) a relatively thin bonding film or layer that operates to bond the palm pad to the palm 11 of glove 10 in the absence of a securing means such as stitching, (2) a relatively thick intermediate padding layer, and (3) a relatively thin surface layer. In a non-limiting embodiment of the invention, the palm pad surface layer was formed of the same material that was used to form palm 11 of glove 10, for example, synthetic leather.

While the invention will be described making reference to palm pads having a relatively thick and intermediate padding layer, the invention also finds utility where the intermediate layer of the palm pad may or may not include padding.

For example, the palm pad intermediate layer may comprise only a relatively thick reinforced fabric that is heat-meltable and whose function it is to reinforce a selected area of the palm 11 of glove 10, or the palm pad relatively thick and intermediate layer may include both a heat-meltable padding and reinforced layer whose function it is to both pad and reinforce a selected area of the palm 11 of glove 10.

While the invention will be described while making reference to an athletic glove 10 wherein pads 12–15 in accordance with the invention are shown on the palm side 11 of glove 10, it is within the spirit and scope of this invention to provide pads constructed and arranged in accordance with the invention on only the back side of an athletic glove, or on both the back side and the palm side of an athletic glove.

In accordance with the invention, all four of the palm pads 12–15 are devoid of stitching and the like, and all four of the palm pads 12–15 are secured or welded to the palm 11 of glove 10 by the operation of a heat-activated adhesive, as permanent depressed lines are formed around and within each of the four palm pads 12–15 by the application of heat and line pressure.

Taking palm pad 12 as an example that is typical of the other three palm pads 13–15, the application of heat and line pressure to palm pad 12 operates to form a thin and continuous depression line 16 that closely follows the entire circumferential edge of palm pad 12, thus ensuring that loose edges of palm pad 12 are not exposed to being caught on an object. That is, the edge or boarder 16 of palm pad 12 effectively merges with the palm surface 11 of glove 10 in the absence of any obstruction, thus minimizing the bulk of glove 10, thus minimizing the chances that edge failure will occur.

In addition, palm pad 12 includes two thin and curved internal depression lines 17 and 18 that lie within the area of palm pad 12. In a like manner, each of the palm pads 13–15 includes an edge depression line and one or more strategically located internal depression lines as is shown in FIG. 1. These internal depression lines are ergonomically located within each of the four palm pads 12–15.

As a result of these internal depression lines, each of the four palm pads 12–15 effectively becomes a multi-pad unit.

That is, (1) palm pad 12 includes two internal and non-intersecting depression lines 17 and 18 that divide the area of palm pad 12 into three individual pad areas, (2) palm pad 13 includes four internal depression lines that intersect and divide the area of palm pad 13 into nine individual pad areas, (3) palm pad 14 includes three internal depression lines that intersect and divide the area of palm pad 14 into six individual pad areas, and (4) palm pad 15 includes three internal depression lines, two of which intersect, thus dividing the area of palm pad 15 into five individual pad areas.

Figure 2:
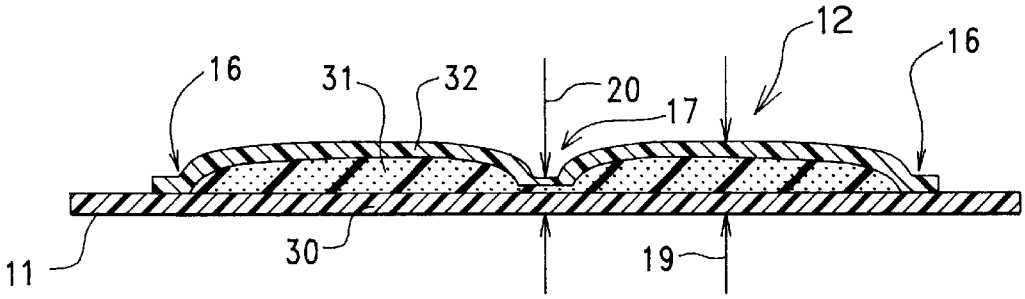
FIG. 2 is an enlarged section view of a first embodiment of one of the four palm pads shown in FIG. 1, FIG. 2 being taken on the line 2—2 of FIG. 1, this figure showing how an edge located depression line causes the palm pad top synthetic leather layer to smoothly blend into the palm of the cycling glove thus minimizing "seam failure" that often occurs when stitching is used and this figure also showing how a depression line that is located within the palm pad "melts" the foam layer and thus operates to emboss the palm pad into two internal pad areas.

FIG. 2 is an enlarged section view of a portion of glove 10 that is taken on the line 2—2 of FIG. 1. FIG. 2 more clearly shows the thin depression line 16 that encircles FIG. 1 palm pad 12, and the relatively long depression line 17 that lies within palm pad 12. As will be appreciated, the thin depression lines that lie within the four palm pads 12–15 facilitate the bending of the palm pads as the hand of an individual wearing glove 10 grasps an object such as the handlebar of a bicycle.

Without limitation thereto, in an embodiment of the invention, the height 19 of palm pads 12–15 was about 5.0 mm, whereas the height 20 of the thin depression lines was about 1.0 mm.

Generally speaking, when three-layer palm pads in accordance with the invention are attached to the palm of an athletic glove, a heated press causes thin depression lines to be embossed into each palm pad, as the foam layer within the palm pad is compress and permanently deformed at the location of the depression lines. Thin and permanent depression lines are formed around the edge of each palm pad, in the absence of the use of stitching and the like. The palm pads are retained on the palm of the glove by operation of the palm pad's adhesive layer. The depression lines remain after the heat and line pressure are removed due to "melting" and/or "cutting" of the foam layer and due to the operation of the adhesive layer.

Figure 3:
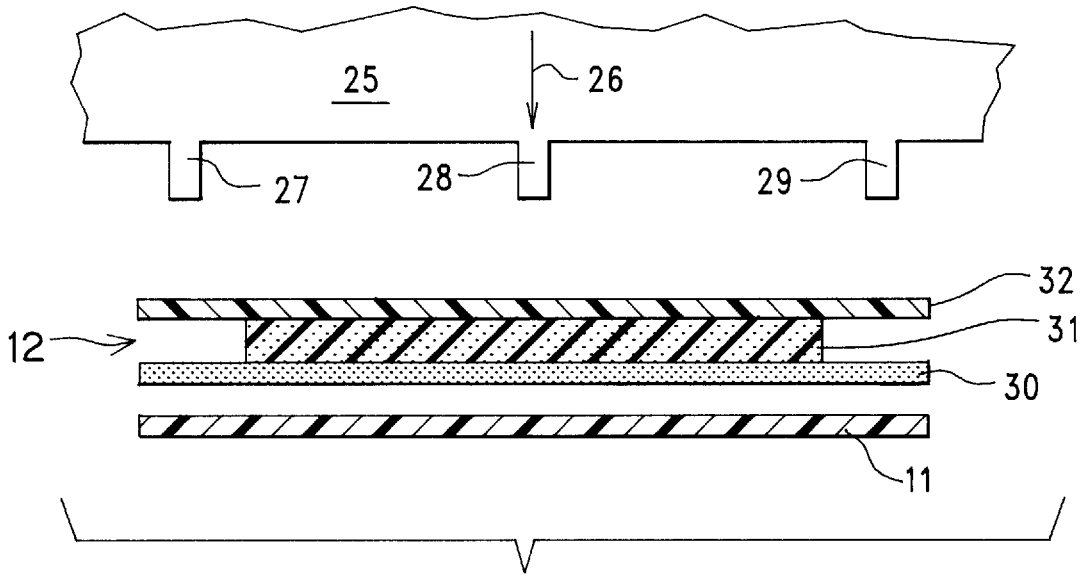
FIG. 3 is an exploded view that shows the FIG. 2 palm pad located above the palm of the FIGS. 1 and 2 glove, as the palm pad awaits the lowering of a heated metal press having three downward extending metal ridges that will selectively compress and "melt" the palm pad's foam layer thus forming the FIGS. 1 and 2 depression lines within the palm pad, the thickness of the palm pad's adhesive thin film layer being greatly exaggerated in this figure.

FIG. 3 is an exploded view that shows palm pad 12 of FIG. 2 positioned above a corresponding the palm of glove 10, as palm 12 waits the lowering of a heated metal press 25, this movement being shown by arrow 26.

As shown in FIG. 3, all four of the FIG. 1 palm pads, including palm pad 12, are of generally a uniform thickness and are a three-layer assembly that includes a bottom and relatively thin heat-activated adhesive 30, a relatively thick and intermediate foam layer 31 that is heat-meltable, and a top and relatively thin synthetic leather layer 32.

In FIG. 3, palm pad 16 is shown palms single unitary assembly wherein its three layers 31–33 have been secured together. For example, adhesive layer 30 has been coated onto the bottom surface of foam layer 31, and synthetic leather layer 32 has been adhesively attached to the top surface of foam layer 31.

While palm pads in accordance with the invention may comprise three layer having generally the same shape and size, FIG. 2 shows that the palm pad top and bottom layers 30 and 32 have generally the same shape and size, whereas the palm pad middle layer 31 is of generally the same shape as the top and bottom layer, but is of a smaller size that the top and bottom layer. Middle layer 31 is centered between top layer 32 and bottom layer 30 so that the circumferential edge of the palm pad comprises only top layer 32 and bottom layer 30.

That is, preferably the top synthetic leather layer 32 and the bottom adhesive layer 30 are slightly larger in planar size than is foam layer 31, the edges of synthetic leather layer and the adhesive layer are aligned, and the foam layer is centered between the synthetic leather layer and the adhesive layer. In this manner, the entire edge of each palm pad comprises the top synthetic leather layer directly engaging the adhesive layer. This construction and arrangement additionally ensures that the edge of the palm pad will smoothly blend into the palm of the glove.

While the palm pads of the invention are described as having a continuous heat-activated adhesive layer 30, heat-activated plastic ribbons may be provided that extend along the circumferential edge of a palm pad and along the palm pad various internal depression lines, such that the use of heat press 25 operates to melt the plastic ribbon and adhesively attach the palm pad to the glove.

In the example of FIG. 3, heat press 25 includes three downward-extending metal ridges or narrow edges 27, 28 and 29 that correspond to the three depression lines 16, 17 and 18 that are shown in FIG. 2. Upon the lowering of heat press 25, the two metal ridges 27 and 29 selectively compress the edge of palm pad 16 to produce the edge located depression line 16 that is shown in FIGS. 1 and 2, whereas metal ridge 28 compresses palm pad 16 to produce the internal depression line 17 that is shown in FIGS. 1 and 2.

In a like manner, heat press 25, or one or more similar heat presses, operate to adhesively attach the three other palm pads to glove 10, as the palm pads are concomitantly embossed.

While the construction and arrangement of FIG. 3 implies that the palm pads are glued to the glove and concomitantly embossed by operation of heat press 25, it is within the spirit and scope of the invention to perform a gluing operation and heating/embossing operation in series.

That is, within the spirit and scope of the invention the various palm pads may be located on the palm of the glove, whereupon the glove is placed in an oven to activate the palm pad's adhesive layer in a manner to "tack" the palm pads to the glove. Thereafter, the glove is placed in the environment that is shown in FIG. 3, whereupon adhesive attachment is completed and the palm pads are embossed.

Figure 4:
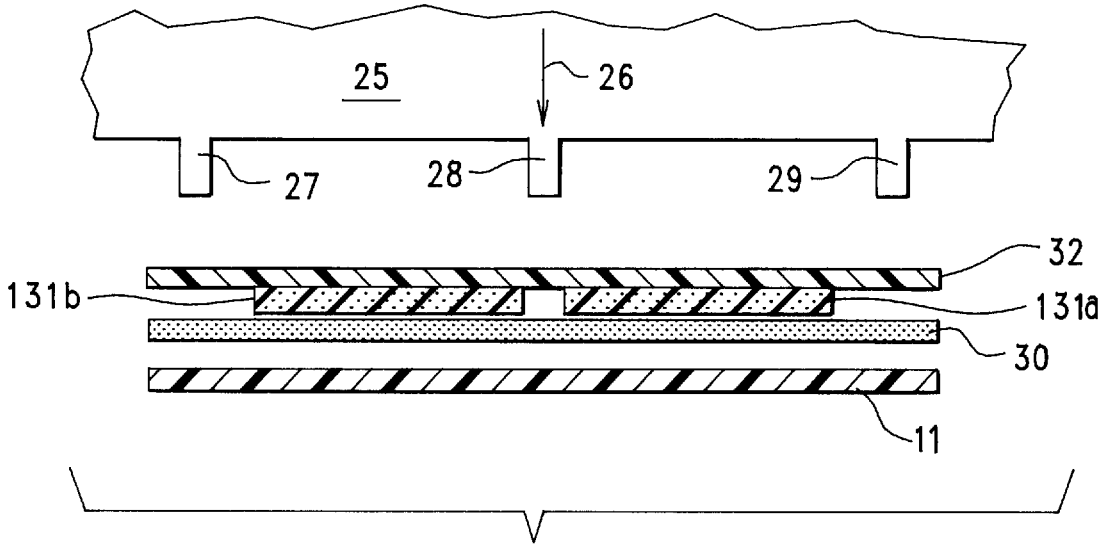
FIG. 4 is a view similar to FIG. 3 that shows a second embodiment of the invention wherein each pad area that lies internal of a palm pad includes its own individual piece of thick foam, such that "melting" of the thick foam layers is not required as it is in the embodiment of FIGS. 2 and 4.

FIG. 4 is a view similar to FIG. 3 that shows a second embodiment of the invention wherein the middle-located and thick foam sheet 31 of FIGS. 2 and 3 is replaced by a foam sheet having two individual pieces 131*a* and 113*b*. In this second embodiment, heat press 25 operates as above-described, with the exception that the palm pad's internal depression line 17 does not include a compressed area of foam. That is, and with reference to FIG. 2, in this second embodiment the palm pad's internal depression line 17 includes only FIG. 4's top synthetic leather layer 32 and FIG. 4's bottom adhesive layer 30.

While the invention has been described in detail while making, reference to preferred embodiments of the invention, it is known that others will, upon learning of the invention, readily visualize other embodiments that are within the spirit and scope of this invention. Thus, this detailed description is not to be taken as a limitation on the spirit and scope of the invention.

What is claimed is:

1. In a glove having a palm surface, an improvement comprising:

a plurality of three-layer palm pads located on said palm surface, each of said palm pads including;

a thin heat-activated adhesive layer abutting said palm surface and operating to secure said palm pad to said palm surface in the absence of stitching;

a thick resilient layer abutting said adhesive layer; and a thin exterior layer abutting said resilient layer;

each of said palm pads being embossed by a continuous heat formed and recessed line that completely encircles an edge of each of said palm pads, to thereby activate said adhesive layer such that said exterior layer of each of said palm pads smoothly blends into said palm surface; and at least one of said palm pads being embossed by at least one heat formed and recessed line that lies internal of said at least one palm pad, to thereby divide said at least one palm pad into a plurality of individual pad areas wherein a thickness of said at least one recessed line is generally equal to a thickness of said thin exterior layer.

2. The improvement of claim 1 wherein said glove is a cycling glove and wherein said a plurality of palm pads are located on said palm surface in a manner to absorb shock and to assist a cyclist in gripping the handlebar of a bicycle.

3. The improvement of claim 1 wherein said plurality of palm pads are ergonomically located on said palm surface.

4. The improvement of claim 1 wherein said resilient layer is a synthetic foam layer.

5. The improvement of claim 4 wherein said synthetic foam layer has a thickness of about 4 millimeters and has a hardness in a range of from about 40 durometer to about 90 durometer.

6. The improvement of claim 5 wherein said glove is a cycling glove and wherein said a plurality of palm pads are located on said palm surface in a manner to absorb shock and assist a cyclist in gripping the handlebar of a bicycle.

7. The improvement of claim 5 wherein said plurality of palm pads are located on said palm surface in a manner to ergonomically absorb shock and assist the hand of an individual to grip an object.

8. The improvement of claim 1 wherein said thick resilient layer within said at least one palm pad comprises a plurality of thick foam pieces, one foam piece for each of said plurality of individual pad areas.

9. The improvement of claim 1 wherein said thick resilient layer comprises a single piece of thick heat-deformable foam.

10. A method of making an athletic glove and the like comprising the steps of:

providing an athletic glove having a palm-surface that is formed of a given material;

providing at least one three-layer palm-pad;

said at least one palm-pad having a continuous edge that encircles said at least one palm pad, a relatively thin and bottom-located heat-activated adhesive layer, a relatively thick and middle-located padding layer, and a relatively thin and top-located exposed layer;

positioning said at least one palm pad on or adjacent to said palm surface with said bottom-located heat-activated adhesive layer facing said palm surface;

providing a heat press having a continuous metal ridge that conforms in shape to said continuous edge of said at least one palm pad;

positioning said heat press such that said continuous metal ridge is in alignment with said continuous edge of said at least one palm-pad; and forcing said heat-press into physical contact with said top-located exposed layer of said at least one palm pad with a pressure, a temperature, and for a time period sufficient to activate said bottom-located heat-activated adhesive layer of said at least one palm pad and to permanently collapse said thick middle-located padding layer such that a thickness of said continuous edge of said at least one palm pad is generally equal to a thickness of said thin top-exposed layer.

11. The method of claim 10 wherein said top-located exposed layer of said at least one palm pad is formed of said given material.

12. The method of claim 10 wherein said middle-located padding layer of said at least one palm pad is a cellular foam.

13. The method of claim 10 wherein said bottom located bottom-located heat-activated adhesive layer and said top-located exposed layer are of generally the same shape and size, wherein said bottom-located heat-activated adhesive layer and said top-located exposed layer are positioned edge coincident, and wherein said relatively thick and middle-located padding layer is of generally the same shape as said bottom-located heat-activated adhesive layer and top-located exposed layer, but is of a somewhat smaller size than said bottom-located heat-activated adhesive layer and top-located exposed layer, such that a circumferential edge of said palm pad comprises said bottom-located heat-activated adhesive layer and said top-located exposed layer.

14. A method of making a cycling glove comprising the steps of:

providing a cycling glove having a palm surface formed of a synthetic leather;

providing a plurality of three-layer palm pads to be glued to a plurality of spaced positions on said palm surface in the absence of the use of stitching or the like;

each of said palm pads including a relatively thin adhesive layer that can be activated by the application of heat, a relatively thick and intermediate synthetic foam layer, and a relatively thin synthetic leather top layer;

providing a heat press having downward-extending metal line areas;

said downward-extending metal line areas including a plurality of continuous metal lines that individual match and completely encircle an edge of each of said plurality of palm pads;

said downward-extending metal line areas including inner metal lines that lie within at least some of said plurality of continuous metal lines;

utilizing said heat press to force each of said plurality of palm pads down onto said palm surface with said adhesive layer of each of said plurality of palm pads abutting said palm surface;

maintaining said heat press in physical contact with said plurality of palm pads with a pressure, at a temperature, and for a time period that is sufficient to activate said adhesive layer of each of said plurality of palm pads;

said heat press operating to activate said adhesive layer of each of said plurality of palm pads as said plurality of continuous metal lines compress said plurality of palm pads to provide a thin line seal at an edge of each said plurality of palm pads and to provide thin depressed lines within at least some of said plurality of palm pads;

said thin depressed lines operating to emboss at least some of said plurality of palm pads in a manner to provide a plurality of embossed pad areas within at least some of said plurality of palm pads; and locating said embossed pad areas on said palm surface in a manner to facilitate bending of said at least some of said plurality of palm pads as the cyclist's hand grasps an object such as the handlebar of a bicycle.

15. The method of claim 14 wherein said synthetic foam layer of each of said plurality of palm pads has a thickness of about 4 millimeters and a hardness in a range of from about 40 durometer to about 90 durometer.

16. The method of claim 15 wherein said adhesive layer is selected from the group polyurethane and polyvinyl chloride.

17. The method of claim 16 wherein said adhesive layer and said synthetic leather layer are of generally the same shape and size, wherein said adhesive layer and said synthetic leather layer are positioned edge coincident, and wherein said synthetic foam layer is of generally said same shape and of a smaller size, such that a circumferential edge of each of said palm pads comprises said adhesive layer and said synthetic leather layer.

18. In an athletic glove having a palm surface, an improvement comprising:

a plurality of three-layer palm pads located on said palm surface, each of said palm pads including;

a heat-activated thin film of adhesive abutting said palm surface and operating to secure said palm pad to said palm surface in the absence of stitching;

a relatively thick and continuous foam layer abutting said adhesive; and an relatively thin and continuous exterior layer abutting said foam layer;

each of said palm pads being embossed by a continuous heat formed and recessed line that completely encircles an edge of each of said palm pads, to thereby activate said adhesive such that said exterior layer of each of said palm pads smoothly blends into said palm surface; and at least one of said palm pads being embossed by at least one heat formed and recessed line that lies internal of said at least one palm pad, to thereby divide said at least one palm pad into a plurality of individual pad areas;

said embossing steps operating to permanently collapse said foam layer at said continuous recessed line and at said at least one recessed line, such that a thickness of said continuous recessed line and said at least one recessed line is generally equal to a thickness of said thin exterior layer.

19. In an athletic glove having a palm surface, an improvement comprising:

a plurality of three-layer palm pads located on said palm surface, each of said palm pads including;

a heat-activated thin film of adhesive abutting said palm surface, said adhesive operating to secure each of said palm pad to said palm surface in the absence of stitching;

a plurality of physically spaced, relatively thick, and continuous foam layers abutting said adhesive; and an relatively thin and continuous exterior layer abutting said foam layers;

each of said palm pads being embossed by a continuous heat formed and recessed line that completely encircles an edge of each of said palm pads, to thereby activate said adhesive such that said exterior layer of each of said palm pads smoothly blends into said palm surface; and each of said palm pads being embossed by heat formed and internal recessed lines that lie internal of each of said palm pads, said internal recessed lines being located in spaces between said plurality of foam layers, to thereby divide each of said palm pads into a plurality of individual pad areas, each individual pad area including one of said plurality of foam layers;

said embossing steps providing that a thickness of said continuous recessed lines and a thickness of said internal recessed lines are generally equal to a thickness of said thin exterior layer.

20. A method of making an athletic glove and the like comprising the steps of:

providing an athletic glove having a palm-surface that is formed of a given material;

providing at least one three-layer palm-pad;

said at least one palm-pad having a continuous edge that encircles said at least one palm pad, a relatively thin and bottom-located heat-activated adhesive layer, a relatively thick and middle-located foam padding layer, and a relatively thin and top-located exposed layer;

positioning said at least one palm pad on or adjacent to said palm-surface with said bottom-located heat-activated adhesive layer facing said palm-surface;

providing a heat press having a continuous metal ridge that conforms in shape to said continuous edge of said at least one palm pad;

positioning said heat press such that said continuous metal ridge is in alignment with said continuous edge of said at least one palm-pad;

forcing said heat-press into physical contact with said top-located exposed layer of said at least one palm pad with a pressure, a temperature, and for a time period sufficient to activate said bottom-located heat-activated adhesive layer of said at least one palm pad; and providing at least one internal metal ridge within said heat press;

said internal metal ridge residing within said continuous metal ridge that conforms in shape to said continuous edge of said at least one palm pad;

said step of forcing said heat-press into physical contact with said top-located exposed layer of said at least one palm pad additionally operating to permanently collapse said middle-located foam padding layer of said at least one palm pad at a location that is coincident with said at least one metal ridge;

whereby said at least one palm pad is embossed by operation of said at least one internal metal ridge.

21. The method of claim 20 wherein said top-located exposed layer of said at least one palm-pad is a cellular foam.

22. The method of claim 21 wherein said middle-located padding layer of said at least one palm-pad is a cellular foam.

23. The method of claim 22 wherein said heat-activated adhesive layer is selected from the group polyurethane and polyvinyl chloride.

* * * * *